US009644524B2

(12) United States Patent
Tada et al.

(10) Patent No.: US 9,644,524 B2
(45) Date of Patent: May 9, 2017

(54) COOLING WATER PASSAGE STRUCTURE

(71) Applicant: HONDA MOTOR CO., LTD., Tokyo (JP)

(72) Inventors: Kazushi Tada, Wako (JP); Yusuke Kato, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 237 days.

(21) Appl. No.: 14/529,152

(22) Filed: Oct. 31, 2014

(65) Prior Publication Data

US 2015/0122205 A1 May 7, 2015

(30) Foreign Application Priority Data

Nov. 7, 2013 (JP) ..... 2013-231480

(51) Int. Cl.
*F01P 5/10* (2006.01)
*F01P 9/00* (2006.01)
(Continued)

(52) U.S. Cl.
CPC ..... *F01P 5/12* (2013.01); *F01P 11/04* (2013.01)

(58) Field of Classification Search
CPC F01P 5/12; F01P 3/20; F01P 2003/008; F01P 5/04; F01P 11/04; F04D 29/126; F04D 1/00
(Continued)

(56) References Cited

U.S. PATENT DOCUMENTS 6,978,742 B2 * 12/2005 Miyagawa ..... F01P 5/10 123/41.1
2008/0006229 A1 * 1/2008 Wilmink ..... B01D 35/153 123/41.33
(Continued)

FOREIGN PATENT DOCUMENTS

CN 103122791 5/2013
JP 4362904 B2 3/2001
(Continued)

OTHER PUBLICATIONS

Japanese Office Action for corresponding JP Application No. 2013-231480, Aug. 4, 2015.
(Continued)

*Primary Examiner* — Carlos A Rivera
*Assistant Examiner* — Syed O Hasan
(74) *Attorney, Agent, or Firm* — Mori & Ward, LLP

(57) ABSTRACT

A cooling water passage structure includes a cooling water passage in an internal combustion engine, a water pump, and a communication member. The communication member has a cooling water communication passage to supply cooling water from the water pump to the cooling water passage. The cooling water communication passage includes a water pump housing, a first cooling water passage, and a second cooling water passage. The water pump housing contains the water pump. The first cooling water passage has a substantially triangular shape that widens from a vertex on an upstream side. The second cooling water passage includes a cylindrical passage extending in a direction orthogonal to an operating axis of the water pump. The second cooling water passage is displaced from an operating plane of the water pump.

18 Claims, 11 Drawing Sheets

(51) Int. Cl.
*F01P 9/04* (2006.01)
*F01P 5/12* (2006.01)
*F01P 11/04* (2006.01)

(58) Field of Classification Search
USPC ..... 123/41.33, 41.34, 41.44–41.47, 41.49, 123/41.6, 41.63; 415/111, 148, 185, 186
See application file for complete search history.

(56) References Cited

U.S. PATENT DOCUMENTS

| | | | | |
|---|---|---|---|---|
| 2012/0247410 | A1* | 10/2012 | Mukouhara ..... | F01P 5/10 123/41.47 |
| 2013/0011250 | A1 | 1/2013 | Fournier et al. | |

FOREIGN PATENT DOCUMENTS

| | | |
|---|---|---|
| JP | 2004-211619 | 7/2004 |
| JP | 2008-101553 | 5/2008 |
| JP | 2013-519828 | 5/2013 |
| JP | 2013-108385 | 6/2013 |
| WO | WO 2013/120543 | 8/2013 |

OTHER PUBLICATIONS

Chinese Office Action for corresponding CN Application No. 201410582496.8, Aug. 1, 2016 (w/ English machine translation).

* cited by examiner

COOLING WATER PASSAGE STRUCTURE

CROSS-REFERENCE TO RELATED APPLICATIONS

The present application claims priority under 35 U.S.C. §119 to Japanese Patent Application No. 2013-231480, filed Nov. 7, 2013, entitled "Cooling Water Passage Structure." The contents of this application are incorporated herein by reference in their entirety.

BACKGROUND

1. Field

The present disclosure relates to a cooling water passage structure.

2. Description of the Related Art

In a cooling device for a water-cooled engine, an impeller of a water pump rotationally driven by the engine rotates in a pump chamber. By this rotation, cooling water in the pump chamber is centrifugally sent toward a discharge portion and supplied to a water jacket of the engine in a circulating manner.

Japanese Unexamined Patent Application Publication No. 2013-108385 describes an accessory supporting structure that supports accessories on an engine body of an internal combustion engine. The accessory supporting structure described in this document includes an accessory unit block in which a downstream-side cooling water passage extending from a pump chamber in a water pump housing in a lower part passes through a curved middle part, extends to an upper part, and reaches a cooling water communication portion communicating with a cooling water inlet in the engine body.

Japanese Patent No. 4362904 describes a cooling device for a water-cooled engine. The cooling device is configured such that when the engine is in a cold state, part of cooling water is not sent to a discharge portion of a water pump. In the cooling device described in this document, a pump housing has a passage communicating with an upper part of a pump chamber and connected to a supply and discharge unit that supplies and discharges a compressible fluid, such as air. With this configuration, part of cooling water is not supplied to a water jacket of the engine in a circulating manner, so as to improve warm-up performance of the engine.

SUMMARY

According to one aspect of the present invention, a cooling water passage structure includes an internal combustion engine, a water pump, and a communication member. The communication member has a cooling water communication passage for supplying cooling water from the water pump to a cooling water passage in the internal combustion engine. The cooling water communication passage is formed by a water pump housing containing the water pump, a first cooling water passage, and a second cooling water passage. Cooling water from the water pump housing passes through the first cooling water passage and the second cooling water passage to reach the cooling water passage in the internal combustion engine. The second cooling water passage is a cylindrical passage extending in a direction orthogonal to an operating axis of the water pump. The second cooling water passage is displaced from an operating plane of the water pump. The first cooling water passage has a substantially triangular shape that widens from a vertex on the upstream side.

According to another aspect of the present invention, a cooling water passage structure includes a cooling water passage in an internal combustion engine, a water pump, and a communication member. The communication member has a cooling water communication passage to supply cooling water from the water pump to the cooling water passage. The cooling water communication passage includes a water pump housing, a first cooling water passage, and a second cooling water passage. The water pump housing contains the water pump. The first cooling water passage has a substantially triangular shape that widens from a vertex on an upstream side. The second cooling water passage includes a cylindrical passage extending in a direction orthogonal to an operating axis of the water pump. The second cooling water passage is displaced from an operating plane of the water pump. Cooling water from the water pump housing is to pass through the first cooling water passage and the second cooling water passage to reach the cooling water passage in the internal combustion engine.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
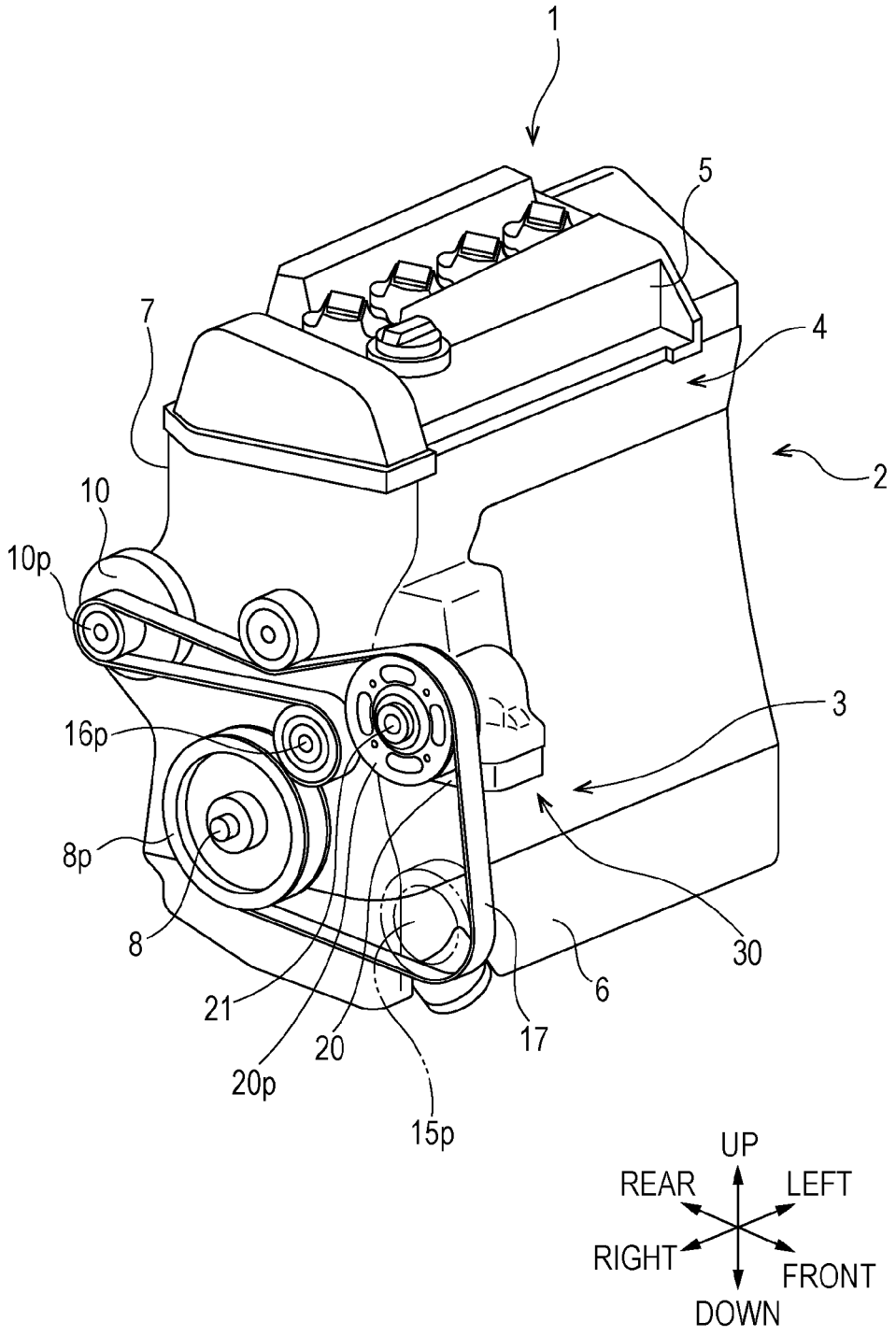
FIG. 1 is an overall perspective view of an internal combustion engine according to an embodiment of the present disclosure.

The embodiments will now be described with reference to the accompanying drawings, wherein like reference numerals designate corresponding or identical elements throughout the various drawings.

Embodiments of the present disclosure will now be described in detail with reference to FIG. 1 to FIGS. 10A and 10B. In the following description, the same elements are denoted by the same reference numerals, and overlapping description will be omitted.

FIG. 1 is an overall perspective view of an internal combustion engine according to an embodiment of the present disclosure.

As illustrated in FIG. 1, an internal combustion engine 1 is a water-cooled internal combustion engine horizontally mounted on the vehicle, with a crank shaft 8 oriented in the right-left direction. In the present specification, the front, rear, right, and left directions are determined with respect to the orientation of the vehicle. Directions shown in the drawings are the cylinder axis direction and the up-down direction. In the present embodiment, the cylinder axis direction coincides with the up-down direction.

An engine body 2 of the internal combustion engine 1 includes a cylinder block 3 in which cylinders are arranged in the right-left direction, a cylinder head 4 on the cylinder block 3, a cylinder head cover 5 which covers the cylinder head 4 from above, and an oil pan 6 joined to the lower part of the cylinder block 3.

An AC generator 10, a water pump 20, and an air-conditioner compressor (not shown), which are accessory components, are sequentially arranged on the right front side of the engine body 2.

The right side surface of the engine body 2 is provided with a drive pulley 8*p* and an idler pulley 16*p* above the drive pulley 8*p*. The drive pulley 8*p* is fitted to an end portion of the crank shaft 8 passing through a chain cover 7. The idler pulley 16*p* is mounted to an end portion of an arm to which a tensioner (not shown) is swingably biased.

A generator pulley 10*p* fitted to an end portion of a drive shaft protruding to the right of the AC generator 10, a water pump pulley 20*p* fitted to an end portion of a pump drive shaft 21 protruding to the right of the water pump 20, and a compressor pulley 15*p* (see an imaginary line) fitted to an end portion of a drive shaft protruding to the right of the compressor (not shown) are in the same vertical plane as the drive pulley 8*p* and the idler pulley 16*p*. An endless belt 17 is looped over the drive pulley 8*p*, the idler pulley 16*p*, the generator pulley 10*p*, the water pump pulley 20*p*, and the compressor pulley 15*p* in this order. Rotation of the drive pulley 8*p* moves the endless belt 17, and this simultaneously drives the AC generator 10, the water pump 20, and the compressor (not shown), which are accessory components.

Cooling water discharged from the water pump 20 first flows into the cylinder block 3 and circulates in a water jacket in the cylinder block 3. Next, the cooling water flows into the cylinder head 4 above the cylinder block 3. The cooling water circulates in a water jacket in the cylinder head 4 to transfer heat from the cylinder block 3 to the cylinder head 4. Then, the cooling water flows out through a water outlet.

The compressor, which is an accessory component, is mounted on the oil pan 6. The AC generator 10, which is also an accessory component, is supported by the cylinder block 3 through an accessory unit block 30 to which the water pump 20 is integrally mounted.

Figure 2:
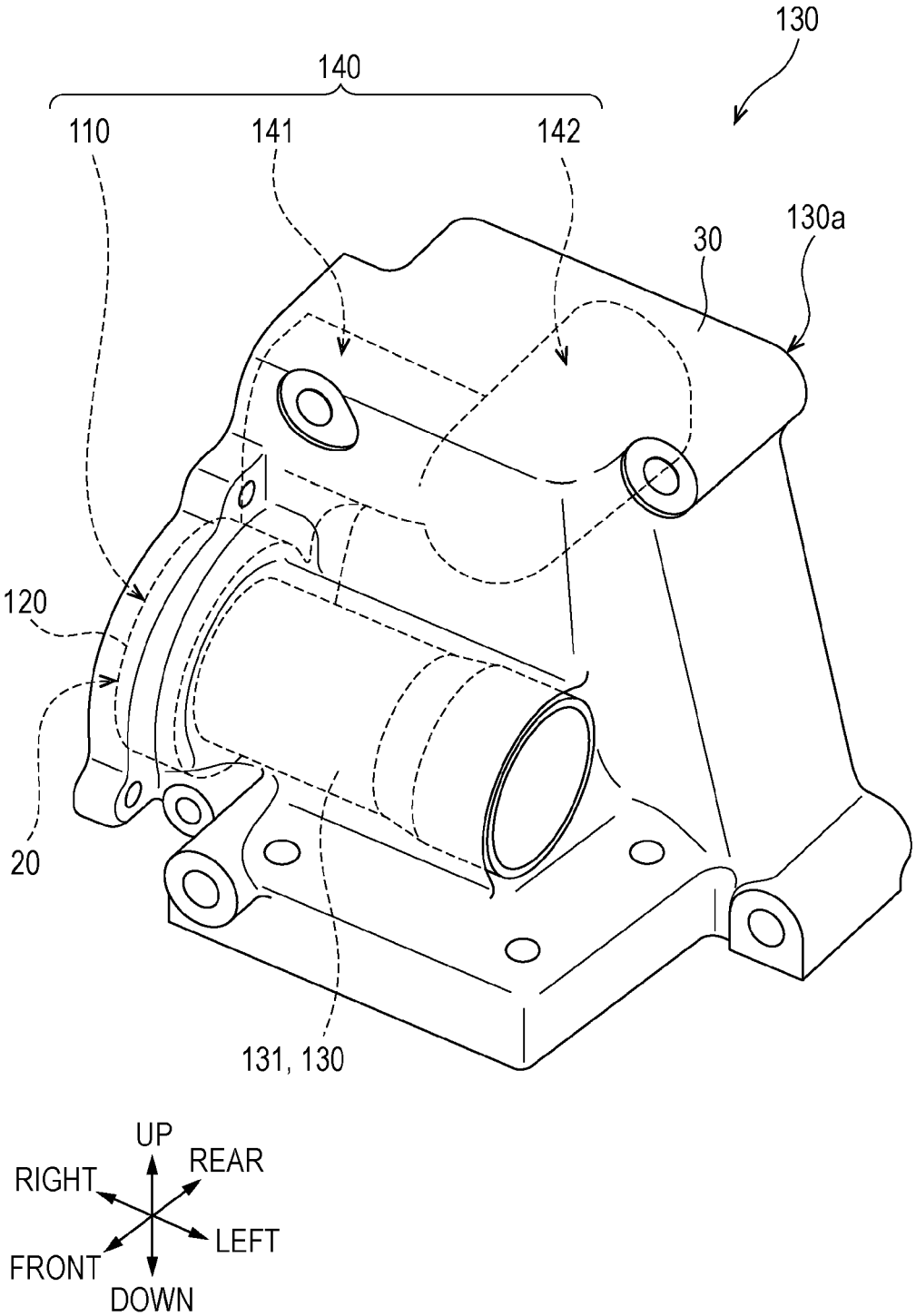
FIG. 2 illustrates a cooling water communication passage that allows cooling water discharged from a water pump in a cooling water passage structure of the embodiment to flow into a cylinder block.

FIG. 2 illustrates the cooling water communication passage 140 that allows cooling water discharged from the water pump 20 to flow into the cylinder block 3.

As indicated by a broken line in FIG. 2, the accessory unit block 30 includes a communication member 130 having a cooling water communication passage 140. The cooling water communication passage 140 is for supplying cooling water from the water pump 20.

The communication member 130 is composed of a main body 130*a* and a water pump cover 120 that covers a side surface of the main body 130*a*. The communication member 130 has an injection path 131 for injecting cooling water from a radiator (not shown) into the water pump 20, and the cooling water communication passage 140 that allows cooling water injected through the injection path 131 to flow into the water jacket in the cylinder block 3.

The cooling water communication passage 140 is formed by a circular water pump housing 110 containing the water pump 20, a first cooling water passage 141 disposed downstream (i.e., on the cooling water discharge side) of the water pump housing 110, and a second cooling water passage 142 configured to allow cooling water from the first cooling water passage 141 to flow to the cylinder block 3.

The water pump cover 120 covers the right side of both the water pump housing 110 and the first cooling water passage 141 in the main body 130*a* of the communication member 130. The cooling water communication passage 140 for the water pump 20 is completed by attaching the water pump cover 120 to the right side of the water pump housing 110 and the first cooling water passage 141.

By driving the water pump 20, cooling water from the radiator (not shown) is injected through the injection path 131 into the water pump housing 110. The cooling water in the water pump housing 110 is discharged by the water pump 20 in the water pump housing 110 to the first cooling water passage 141. Then, after passing through the second cooling water passage 142 communicating with the first cooling water passage 141, the cooling water is supplied to the water jacket in the cylinder block 3.

Figure 3A:
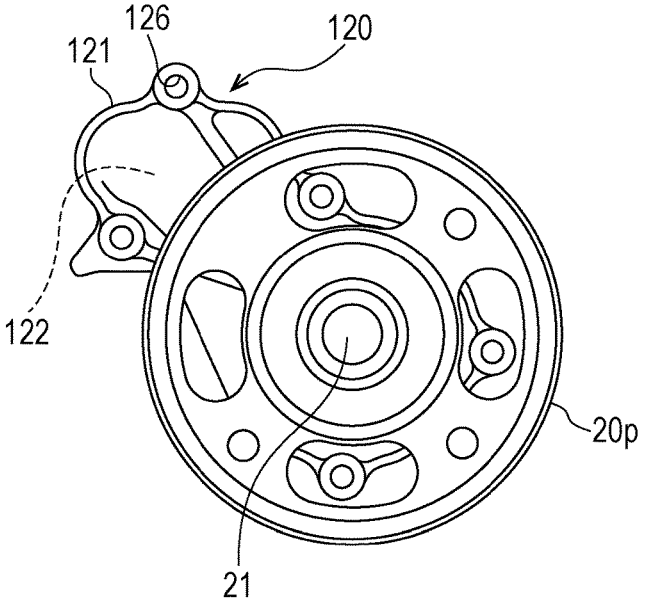
FIGS. 3A to 3C illustrate a water pump cover in the cooling water passage structure of the embodiment.
Figure 3C:
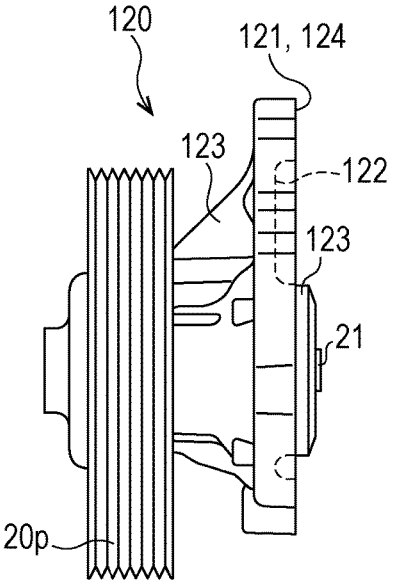
Figure 3B:
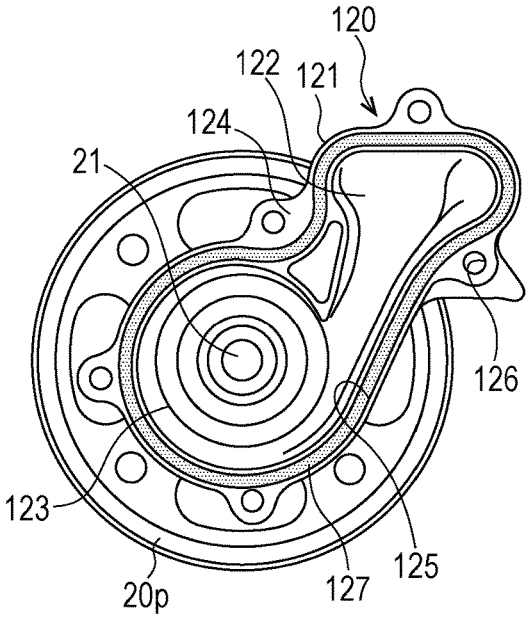

FIGS. 3A to 3C illustrate the water pump cover 120. FIG. 3A illustrates the water pump cover 120 as viewed from the right side in the cylinder axis direction (i.e., as viewed from the front of the water pump cover 120). FIG. 3B illustrates the water pump cover 120 as viewed from the left side in the cylinder axis direction (i.e., as viewed from the back of the water pump cover 120). FIG. 3C illustrates the water pump cover 120 as viewed in a direction orthogonal to the cylinder axis direction (i.e., as viewed from a side of the water pump cover 120).

As illustrated in FIGS. 3A to 3C, the water pump cover 120 has a flat mating face 121 facing a mating face (not shown) of the water pump housing 110, a water passage portion 122, a bearing cylinder portion 123 protruding rightward from a lower part of the water passage portion 122, and a mounting face 124 corresponding to the mating face (not shown) of the water pump housing 110.

The bearing cylinder portion 123 rotatably supports the pump drive shaft 21. An impeller (not shown) is fitted to a left end portion of the pump drive shaft 21 protruding to a pump chamber. As illustrated in FIG. 3C, the water pump pulley 20*p* is fitted to the right end portion of the pump drive shaft 21 protruding from the bearing cylinder portion 123 for the pump drive shaft 21.

As illustrated in FIG. 3B, an outer edge of the mounting face 124 has a groove 125, in which a sealing member 127 is fitted. The mounting face 124 has mounting holes 126 for mounting the water pump cover 120 to the corresponding mounting boss part (not shown) of the water pump housing 110.

After the mating face (not shown) of the water pump housing 110 and the mating face 121 of the water pump cover 120 are brought into contact, the water pump cover 120 is fastened to the corresponding mounting boss part (not shown) of the water pump housing 110 by passing mounting bolts through the mounting holes 126. Thus, the main body 130*a* having the water pump housing 110 and the water pump cover 120 combine to form the communication member 130 having the cooling water communication passage 140.

Figure 4:
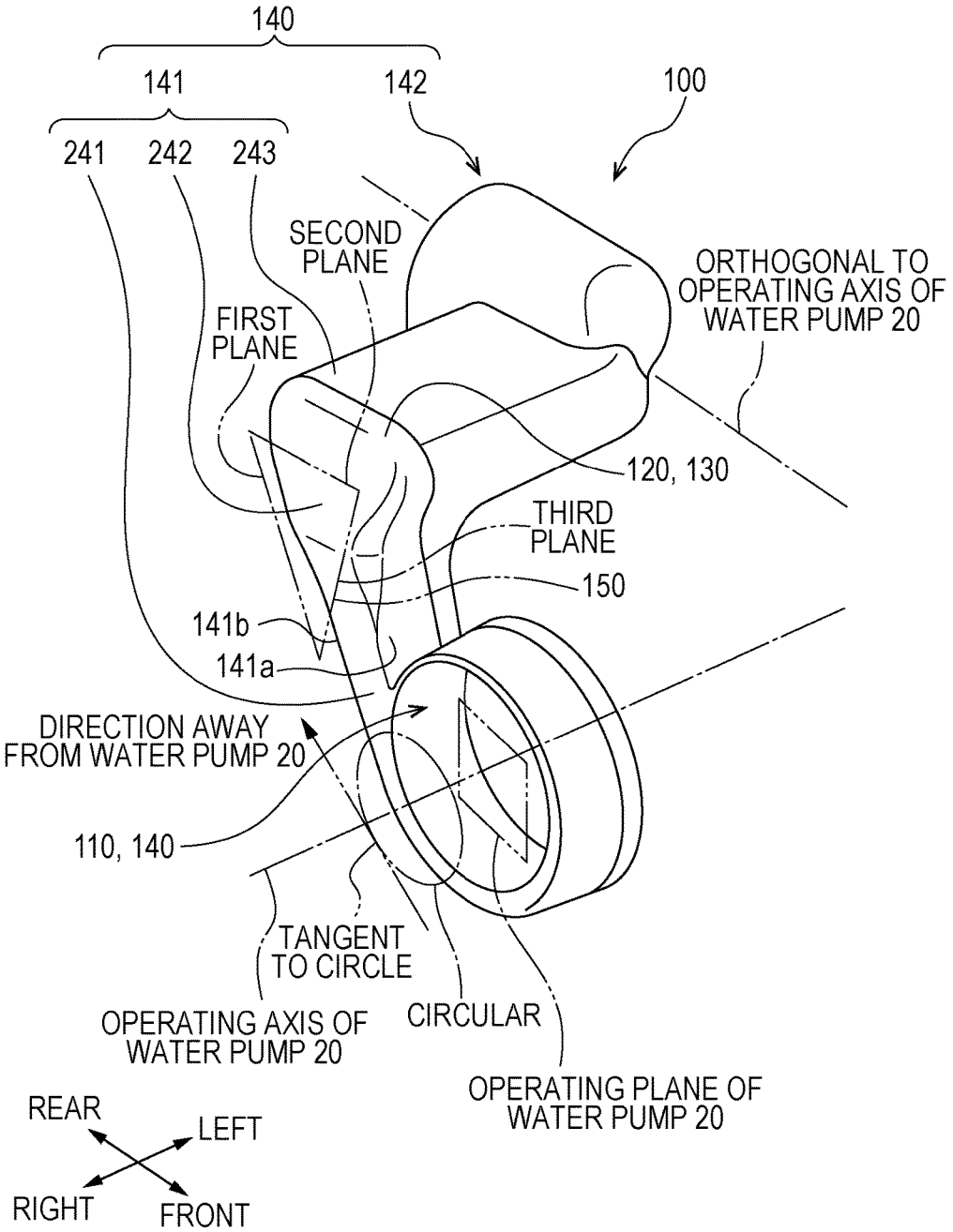
FIG. 4 is a perspective view illustrating a configuration of the cooling water communication passage formed by a water pump housing to which the water pump cover in the cooling water passage structure of the embodiment is mounted.
Figure 5:
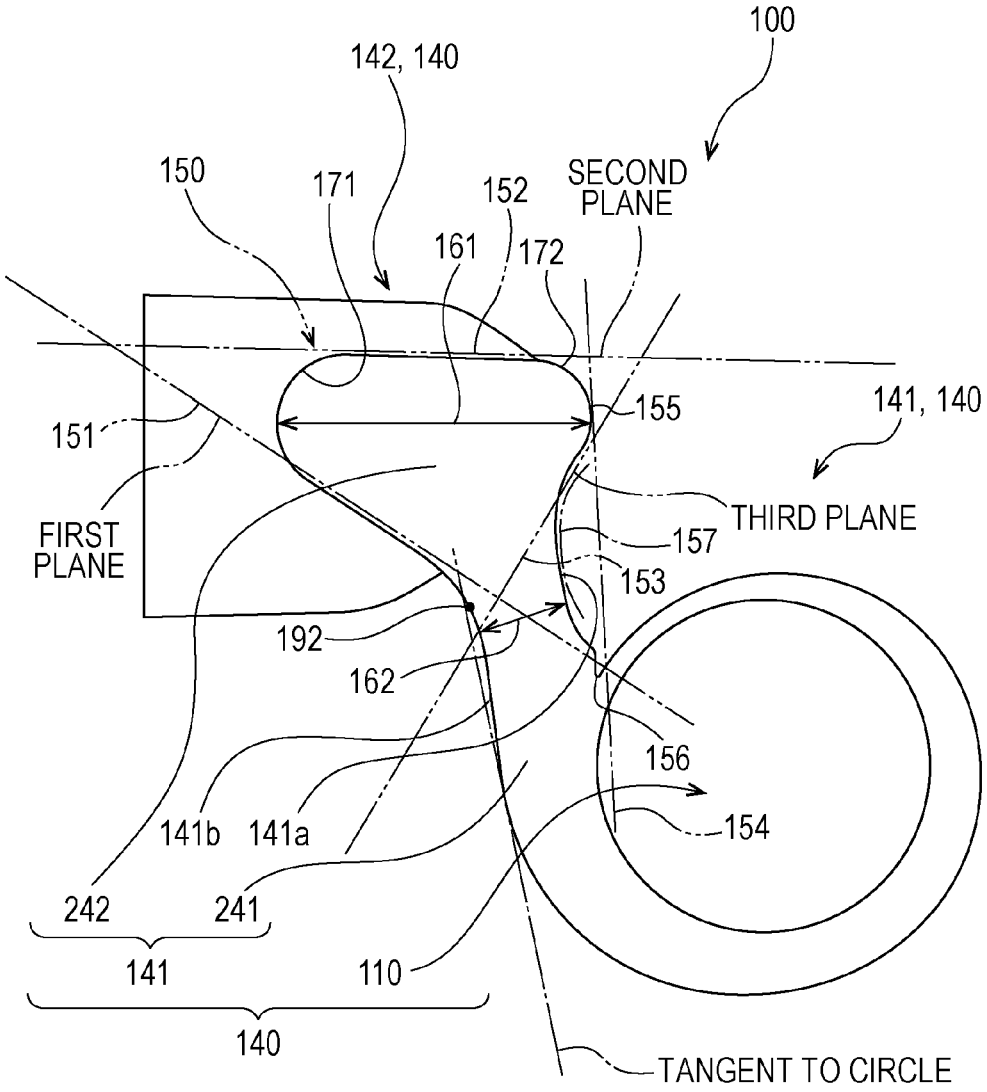
FIG. 5 illustrates a configuration of the cooling water communication passage as viewed in the direction of the operating axis of the water pump in the cooling water passage structure of the embodiment.
Figure 6A:
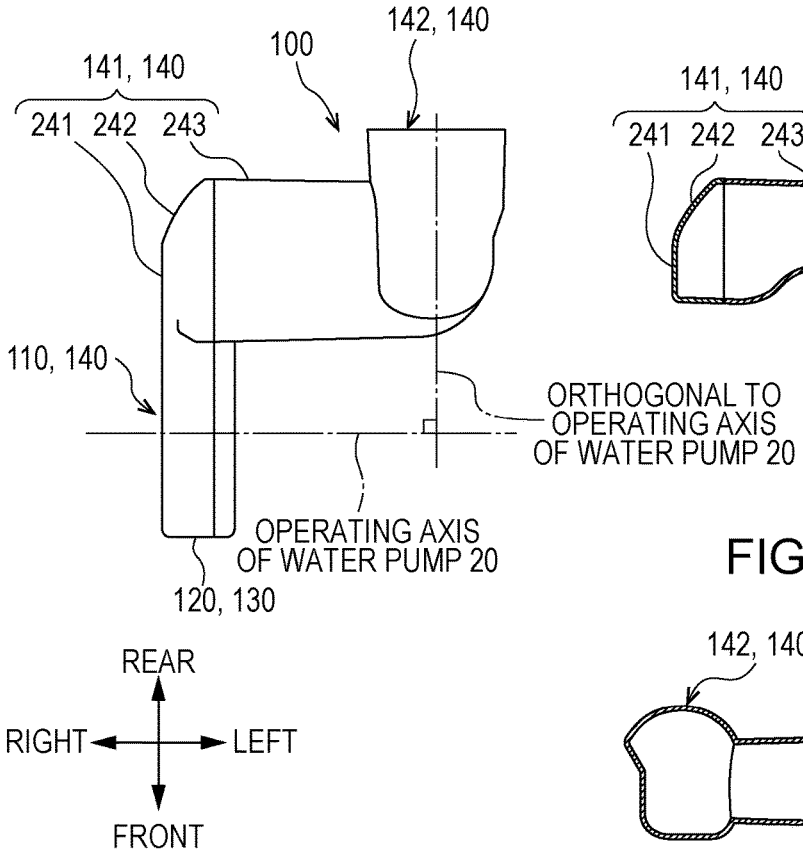
FIGS. 6A to 6C illustrate the configuration of the cooling water communication passage in the cooling water passage structure of the embodiment.
Figure 6B:
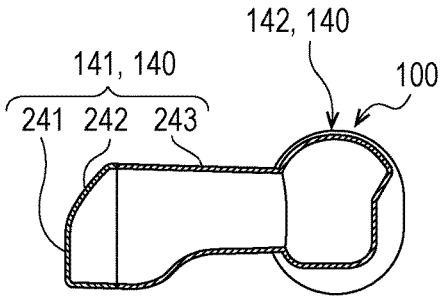
Figure 6C:
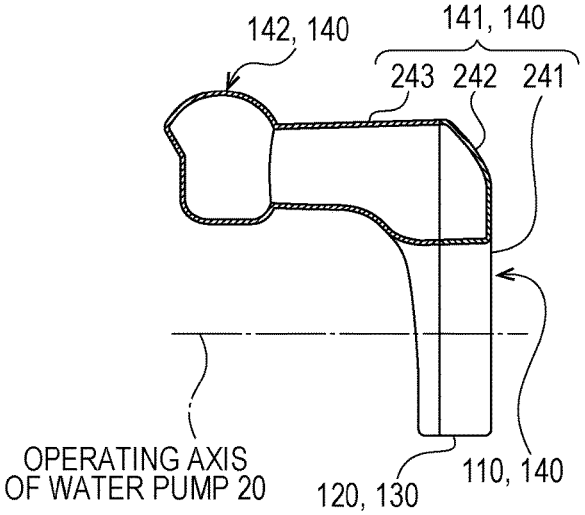

FIG. 4 is a perspective view illustrating a configuration of the cooling water communication passage 140 formed by the water pump housing 110 to which the water pump cover 120 is mounted (hereinafter simply referred to as the water pump housing 110). FIG. 5 illustrates a configuration of the cooling water communication passage 140 as viewed in the direction of the operating axis of the water pump 20. FIGS. 6A to 6C illustrate the configuration of the cooling water communication passage 140 as viewed from above (i.e., from the cylinder head 4).

As illustrated in FIG. 4, FIG. 5, and FIGS. 6A to 6C, a cooling water passage structure 100 includes the communication member 130 having the cooling water communication passage 140 for supplying cooling water from the water pump 20 (see FIG. 1) to a cooling water passage (not shown) in the cylinder block 3 (engine body 2).

Although the main body 130*a* and the water pump cover 120 combine to form the communication member 130 in the present embodiment, the main body 130*a* and the water pump cover 120 may be integrally formed as a single unit. In the present embodiment, the main body 130*a* and the water pump cover 120 are formed as separate units to improve moldability and mounting workability.

As illustrated in FIGS. 4 and 5, the cooling water communication passage 140 is a water passage leading from the water pump 20 to the cooling water passage (not shown) in the cylinder block 3 (engine body 2). The cooling water communication passage 140 is formed by the circular water pump housing 110 containing the water pump 20, the first cooling water passage 141 disposed downstream (i.e., on the cooling water discharge side) of the water pump housing 110 and having a plane parallel to the operating plane of the water pump 20, and the second cooling water passage 142 extending in a direction orthogonal to the operating axis of the water pump 20. The second cooling water passage 142 is a cylindrical passage displaced from the operating plane of the water pump 20, and is configured to allow cooling water from the first cooling water passage 141 to flow to the cylinder block 3.

Cooling water flowing from the radiator into the water pump housing 110 passes through the first cooling water passage 141 and the second cooling water passage 142 and flows into the cooling water passage (not shown) in the internal combustion engine 1.

The first cooling water passage 141 has a water pump housing communication part 241 communicating with the water pump housing 110, a triangular part 242 having a substantially triangular shape that widens from a vertex on the upstream side, and an upper communication part 243 configured to allow the upper portion of the triangular part 242 to communicate with the second cooling water passage 142.

In FIGS. 4 and 5, as viewed in the direction of the operating axis of the water pump 20, the first cooling water passage 141 has an inner surface 141*a* on a side close to the water pump 20, and an outer surface 141*b* opposite the inner surface 141*a*. Specifically, the inner surface 141*a* forms a side portion of the first cooling water passage 141 facing the circular water pump housing 110, and the outer surface 141*b* opposite the inner surface 141*a* forms another side portion of the first cooling water passage 141.

The inner surface 141*a* has a water partition 156 at a point touching the circle of the water pump housing 110. The outer surface 141*b* extends from the point of connection with the water pump housing 110 in the direction of tangent to the water pump housing 110, passes through a point opposite the water partition 156 (see a widening start portion 192), and then turns to extend away from the water pump 20 to widen the first cooling water passage 141.

Figure 7B:
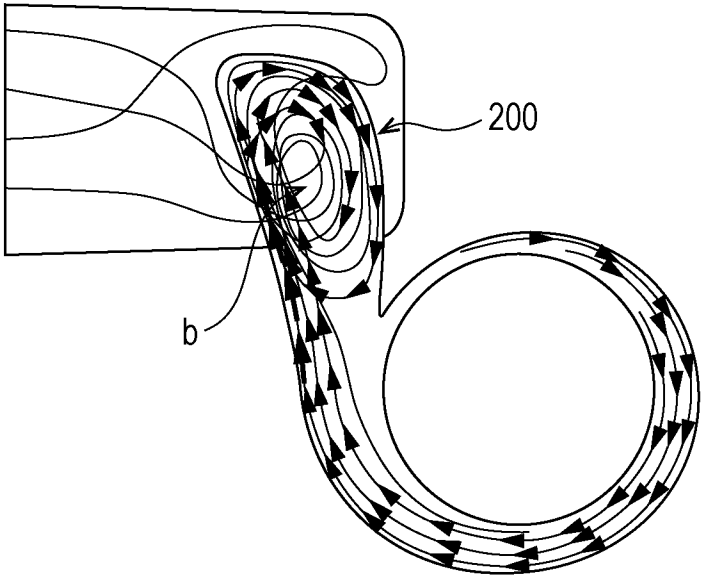
FIGS. 7A and 7B are for explaining a flow of water in the cooling water communication passage, as viewed in the direction of the operating axis of the water pump (i.e., as viewed from the front side of the water pump) in the cooling water passage structure of the embodiment.
Figure 7A:
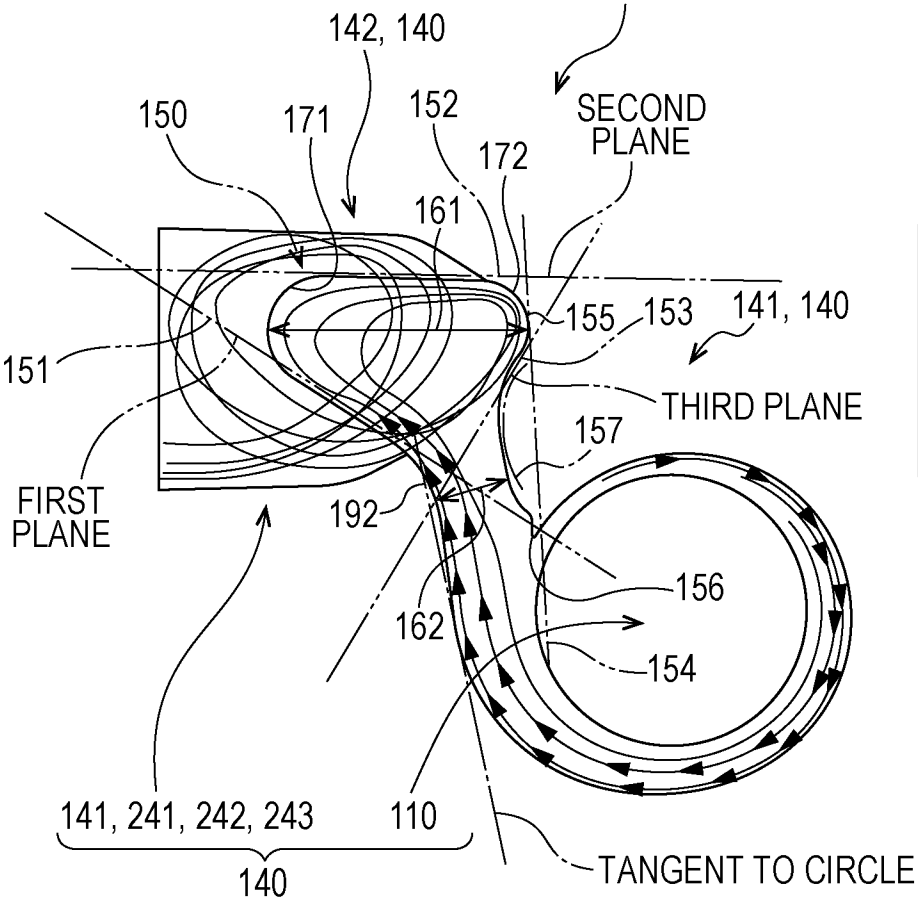

FIGS. 7A and 7B are for explaining a flow of water in the cooling water communication passage 140, as viewed in the direction of the operating axis of the water pump 20 (as viewed from the front side of the water pump 20). FIG. 7A illustrates a flow of water in the cooling water communication passage 140 in the cooling water passage structure 100 of the present embodiment. As a comparative example, FIG. 7B illustrates a flow of water in the cooling water communication passage 200 of the related art. In FIGS. 7A and 7B, a result obtained by fluid simulation is represented by a line with arrows. In the drawings, a region of high flow velocity is indicated by bold arrows.

Figure 8B:
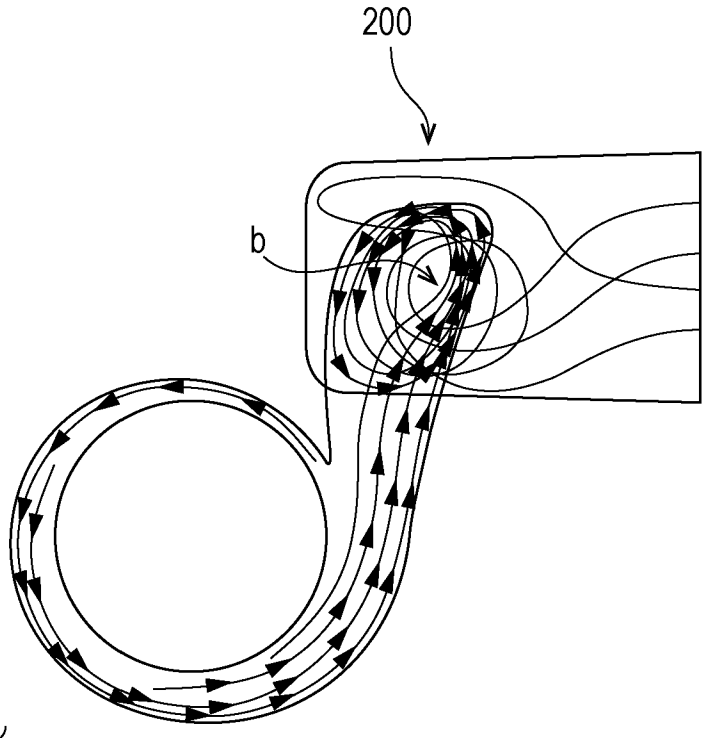
FIGS. 8A and 8B are for explaining a flow of water in the cooling water communication passage, as viewed in the direction of the operating axis of the water pump (i.e., as viewed from the back side of the water pump) in the cooling water passage structure of the embodiment.
Figure 8A:
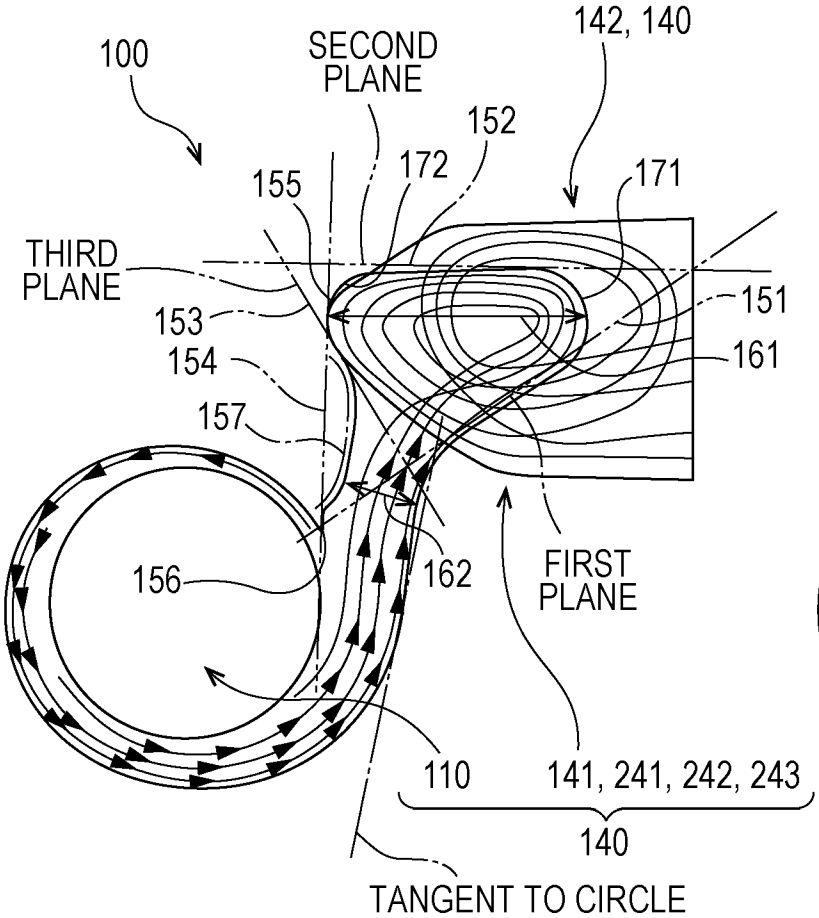

FIGS. 8A and 8B are for explaining a flow of water in the cooling water communication passage 140, as viewed in the direction of the operating axis of the water pump 20 (as viewed from the back side of the water pump 20). FIG. 8A illustrates a flow of water in the cooling water communication passage 140 in the cooling water passage structure 100 of the present embodiment. As a comparative example, FIG. 8B illustrates a flow of water in the cooling water communication passage 200 of the related art.

Referring to FIGS. 4, 5, 7A, and 8A, as viewed in the direction of the operating axis of the water pump 20, the first cooling water passage 141 forms a first plane in part of the outer surface 141*b*, a third plane in part of the inner surface 141*a*, and a second plane in part of a plane connecting the first plane to the third plane. A first imaginary line 151 along the first plane, a second imaginary line 152 along the second plane, and a third imaginary line 153 along the third plane intersect to form a triangle 150.

In the present embodiment, the first cooling water passage 141 has the triangular part 242 that allows the water passage to gradually widen from the water pump housing communication part 241 toward an upper end portion. Thus, the planar portions of the triangular part 242 can reduce the occurrence of excessive swirling flow. In the comparative example illustrated in FIGS. 7B and 8B, the occurrence of swirling flow in the cooling water communication passage 200 resulted in an increase in pressure loss in the water passage. In the present embodiment, the occurrence of swirling flow in the first cooling water passage 141 was found to be reduced.

As illustrated in FIGS. 5, 7A, and 8A, the inner surface 141*a* of the first cooling water passage 141 has a curved portion (which is a semicircular portion 157 here) extending from a lower end of a plane containing an end portion 155 of the first cooling water passage 141 to the water partition 156 at the point of connection between the water pump housing 110 and the inner surface 141*a*. The end portion 155 is on a side close to the water pump housing 110, and is located near the point of intersection of the second imaginary line 152 and the third imaginary line 153. The first cooling water passage 141 is narrowed at the curved portion (semicircular portion 157) concaved from a fourth imaginary line 154 connecting the end portion 155 to the water partition 156.

As illustrated in FIGS. 7A and 8A, the first cooling water passage 141 is narrowed at the semicircular portion 157 concaved from the fourth imaginary line 154. This can prevent collision between cooling water swirling in the triangular part 242 and cooling water discharged from around the water partition 156, which is at the point of connection between the water pump housing 110 and the inner surface 141*a* of the first cooling water passage 141. Additionally, since the first cooling water passage 141 widens at the triangular part 242 on the downstream side, the cooling water can be supplied through a flow passage with large curvature.

Referring to FIGS. 5, 7A, and 8A, as viewed in the direction of the operating axis of the water pump 20, a widest portion 161 of the first cooling water passage 141 has a width that allows a flow velocity in a narrowest portion 162 to be maintained in the widest portion 161. Specifically, the widest portion 161 is about twice the width of the narrowest portion 162, so that it is possible not only to maintain an appropriate flow velocity, but also to prevent creation of areas where cooling water does not flow.

As illustrated in FIGS. 5, 7A, and 8A, the first cooling water passage 141 has a shape formed by connecting the first imaginary line 151 to the second imaginary line 152 through a first semicircular portion 171, and connecting the second imaginary line 152 to the third imaginary line 153 through a second semicircular portion 172. Thus, the semicircular corners of the triangular part 242 allow smooth flow of cooling water.

Figure 9B:
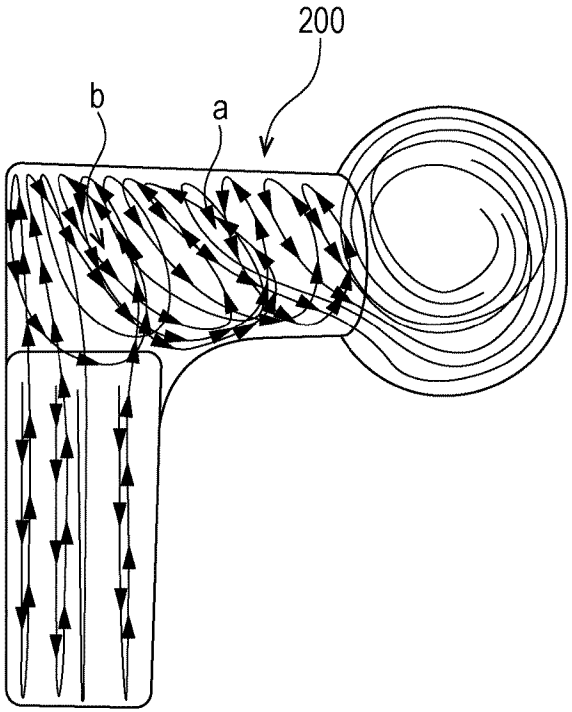
FIGS. 9A and 9B are for explaining a flow of water in the cooling water communication passage as viewed from the front, that is, as viewed in the direction orthogonal to the operating axis of the water pump in the cooling water passage structure of the embodiment.
Figure 9A:
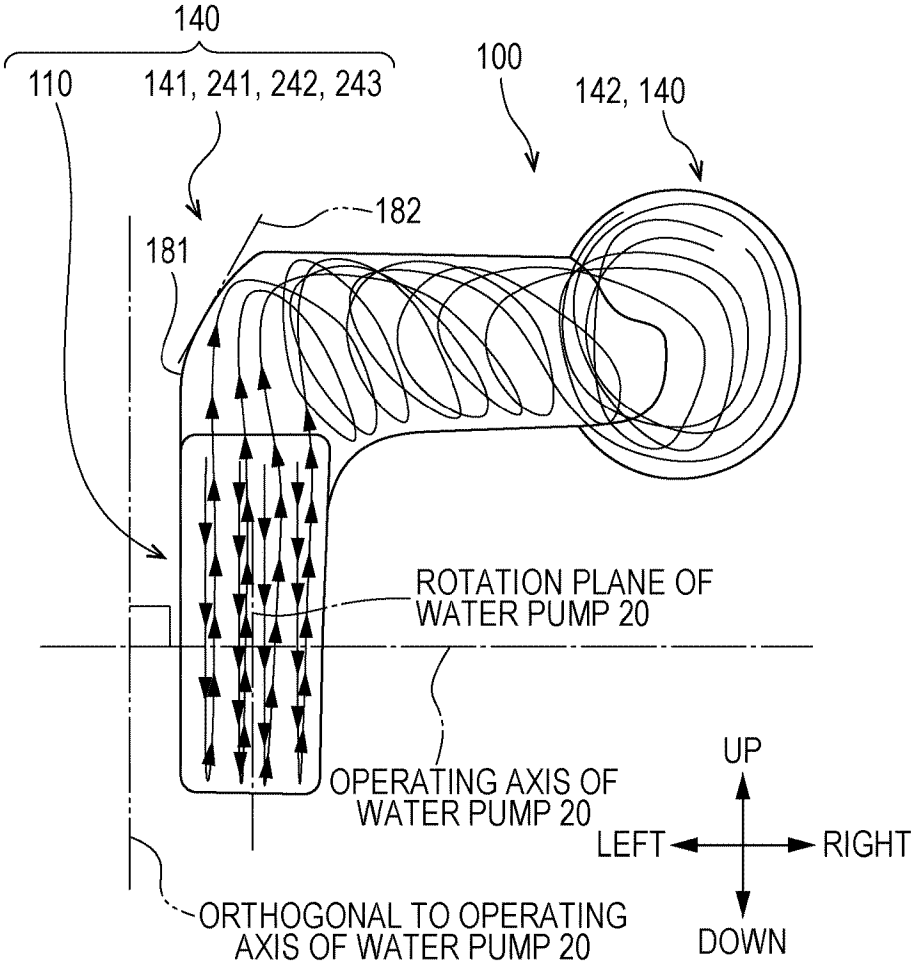

FIGS. 9A and 9B are for explaining a flow of water in the cooling water communication passage 140 as viewed from the front, that is, as viewed in the direction orthogonal to the operating axis of the water pump 20. FIG. 9A illustrates a flow of water in the cooling water communication passage 140 of the present embodiment. As a comparative example, FIG. 9B illustrates a flow of water in the cooling water communication passage 200 of the related art.

Figure 10B:
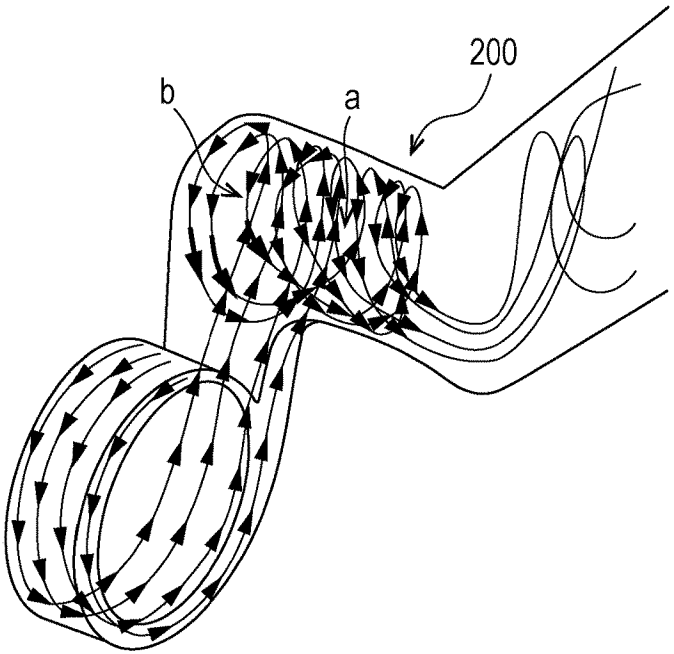
FIGS. 10A and 10B are for explaining a flow of water in the cooling water communication passage, as viewed diagonally from the upper left (back) side of the operating axis of the water pump in the cooling water passage structure of the embodiment.
Figure 10A:
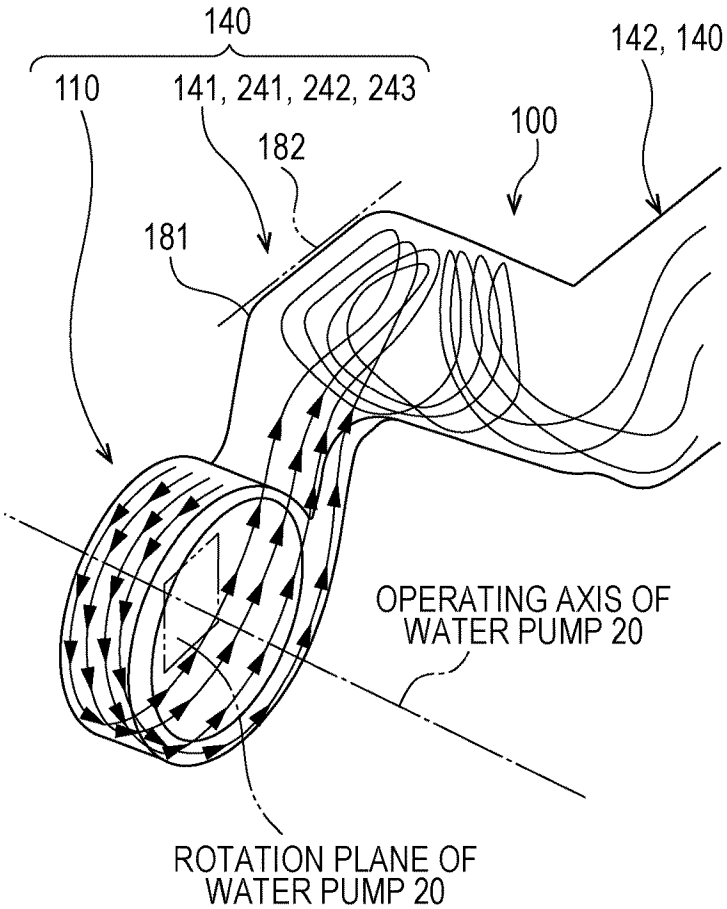

FIGS. 10A and 10B are for explaining a flow of water in the cooling water communication passage 140, as viewed diagonally from the upper left (back) side of the operating axis of the water pump 20. FIG. 10A illustrates a flow of water in the cooling water communication passage 140 of the present embodiment. As a comparative example, FIG. 10B illustrates a flow of water in the cooling water communication passage 200 of the related art.

Referring to FIGS. 9A and 10A, as viewed in the direction orthogonal to the operating axis of the water pump 20 and parallel to the second cooling water passage 142, an end portion 181 of the first cooling water passage 141 close to the water pump 20 becomes more inclined with respect to a rotation plane of the water pump 20 toward the second cooling water passage 142 along an inclined surface 182, with distance from the water pump 20 in the direction of an operating axis of the second cooling water passage 142.

This allows cooling water splashing back from the inclined surface 182 of the triangular part 242 of the first cooling water passage 141 to flow in the direction of the upper communication part 243 and the second cooling water passage 142. In the comparative example illustrated in FIGS. 9B and 10B, the occurrence of swirling flow in the cooling water communication passage 200 resulted in an increase in pressure loss in the water passage. It was found, in the present embodiment, that the occurrence of swirling flow in the first cooling water passage 141 was reduced and cooling water discharged from the water pump 20 was effectively guided to the second cooling water passage 142.

The upper communication part 243 extending to the second cooling water passage 142 have substantially the same width as that of the upper surface of the triangular part 242.

As described above, the cooling water passage structure 100 of the present embodiment includes the communication member 130 having the cooling water communication passage 140 for supplying cooling water from the water pump 20. The cooling water communication passage 140 is formed by the circular water pump housing 110 containing the water pump 20, the first cooling water passage 141 disposed downstream (i.e., on the cooling water discharge side) of the water pump housing 110 and having a plane parallel to the operating plane of the water pump 20, and the second cooling water passage 142 extending in the direction orthogonal to the operating axis of the water pump 20. The second cooling water passage 142 is a cylindrical passage displaced from the operating plane of the water pump 20, and is configured to allow cooling water from the first cooling water passage 141 to flow to the cylinder block 3. The first cooling water passage 141 has the water pump housing communication part 241 communicating with the water pump housing 110, the triangular part 242 having a substantially triangular shape that widens from a vertex on the upstream side, and the upper communication part 243 configured to allow the upper portion of the triangular part 242 to communicate with the second cooling water passage 142.

If all surfaces of the first cooling water passage 141 have the same radius of curvature, the resulting increase in the occurrence of swirling flow leads to an increase in pressure loss. In the present embodiment, the first cooling water passage 141 has a shape formed by combining planar portions. Specifically, the first cooling water passage 141 has a substantially triangular shape that gradually widens from the water pump housing communication part 241 toward the upper end portion. With this triangular shape formed by combining planar portions, the occurrence of excessive swirling flow can be reduced. Since a sufficient amount of cooling water can be supplied into the engine, there is no need to increase the size of the pump or the water passage, and space saving can be achieved.

In the present embodiment, as viewed in the direction of the operating axis of the water pump 20, the first cooling water passage 141 has the inner surface 141*a* on a side close to the water pump 20 and the outer surface 141*b* on a side opposite the inner surface 141*a*. The water pump housing 110 is circular in shape. The inner surface 141*a* has the water partition 156 at a point touching the circle of the water pump housing 110. The outer surface 141*b* extends from the point of connection with the water pump housing 110 in the direction of tangent to the water pump housing 110, passes through a point opposite the water partition 156 (see the widening start portion 192), and then turns to extend away from the water pump 20 to widen the first cooling water passage 141.

The water pump 20 centrifugally discharges cooling water. Therefore, if the first cooling water passage 141 gradually widens from the water pump housing 110, the flow of water along the inner surface 141*a* of the first cooling water passage 141 is slowed down. With the configuration described above, as illustrated in FIGS. 7A and 8A, it is possible to reduce the possibility that water will swirl around the water partition 156 at a point where the inner surface 141*a* of the first cooling water passage 141 touches the circle of the water pump housing 110 and the flow velocity is relatively low.

In the present embodiment, as viewed in the direction of the operating axis of the water pump 20, the first cooling water passage 141 forms the first plane in part of the outer surface 141*b*, the third plane in part of the inner surface 141*a*, and the second plane in part of the plane connecting the first plane to the third plane. The first imaginary line 151 along the first plane, the second imaginary line 152 along the second plane, and the third imaginary line 153 along the third plane intersect to form the triangle 150. The inner surface 141*a* of the first cooling water passage 141 has a curved portion (semicircular portion 157) extending from a lower end of a plane containing the end portion 155 of the first cooling water passage 141 to the water partition 156 at the point of connection between the water pump housing 110 and the inner surface 141*a*. The end portion 155 is on a side close to the water pump housing 110, and is located near the point of intersection of the second imaginary line 152 and the third imaginary line 153. The first cooling water passage 141 is narrowed at the curved portion (semicircular portion 157) concaved from the fourth imaginary line 154 connecting the end portion 155 to the water partition 156.

As illustrated in FIGS. 7A and 8A, the first cooling water passage 141 is narrowed at the semicircular portion 157 concaved from the fourth imaginary line 154. This can prevent collision between cooling water swirling in the triangular part 242 and cooling water discharged from around the water partition 156. Also, since the first cooling water passage 141 widens at the triangular part 242 on the downstream side, cooling water can be supplied through a flow passage with large curvature.

In the present embodiment, as viewed in the direction orthogonal to the operating axis of the water pump 20 and parallel to the second cooling water passage 142, the end portion 181 of the first cooling water passage 141 close to the water pump 20 becomes more inclined with respect to the rotation plane of the water pump 20 toward the second cooling water passage 142, with distance from the water pump 20 in the direction of the operating axis of the second cooling water passage 142.

As illustrated in FIGS. 9A and 10A, the end portion 181 of the first cooling water passage 141 close to the water pump 20 is inclined toward the second cooling water passage 142. This allows cooling water splashing back from the inclined portion of the first cooling water passage 141 to flow in the direction of the second cooling water passage 142. Therefore, unlike the comparative example based on the related art illustrated in FIGS. 9B and 10B, it is possible to prevent collision with cooling water around the water pump 20 and the resulting swirls (see "b" in FIGS. 9B and 10B). Moreover, the upper end portion of the triangular part 242 of the first cooling water passage 141 is not only inclined but is also significantly convex from a line tangent to the inner surface 141*a* of the first cooling water passage 141. Therefore, it is possible to increase the width of inclination and more effectively reduce the occurrence of swirls.

In the present embodiment, as viewed in the direction of the operating axis of the water pump 20, the widest portion 161 of the first cooling water passage 141 has a width that allows a flow velocity in the narrowest portion 162 to be maintained in the widest portion 161.

For example, if the flow passage is narrow, the flow quantity of cooling water decreases, and this results in a decrease in the absolute amount of cooling water that can flow. On the other hand, if the flow passage is too wide, the flow velocity decreases and the cooling water does not flow in some areas. In the present embodiment, where a flow passage has a width which does not cause a significant decrease in flow velocity (e.g., the widest portion 161 is about twice the width of the narrowest portion 162), it is possible to prevent creation of areas where the cooling water does not flow.

Also in the present embodiment, the first cooling water passage 141 has a shape formed by connecting the first imaginary line 151 to the second imaginary line 152 through the first semicircular portion 171, and connecting the second imaginary line 152 to the third imaginary line 153 through the second semicircular portion 172. Thus, the semicircular corners of the triangular part 242 allow smooth flow of cooling water.

As viewed in the direction orthogonal to the operating axis of the water pump 20 and parallel to the second cooling water passage 142, the width of the first cooling water passage 141 in the direction orthogonal to the flow direction may be substantially the same as the width of the second cooling water passage 142 in the direction orthogonal to the flow direction. An end portion of the first cooling water passage 141 close to the water pump 20 may be connected by a curve or straight line to an end portion of the second cooling water passage 142 remote from the water pump 20.

With this configuration in which the first cooling water passage 141 is connected by a curve or straight line to the second cooling water passage 142, cooling water passing through the first cooling water passage 141 can be smoothly guided to the second cooling water passage 142. By expanding the width of the flow passage as much as possible, water splashing back after being discharged from the water pump 20 can be prevented from colliding with the flow of water in the first cooling water passage 141.

Although the cooling water passage structure of the embodiments has been described in detail with reference to the drawings, the present disclosure is not limited to the embodiments and examples described above. The present disclosure may be changed as appropriate without departing from the scope of the present disclosure.

Figure 11:
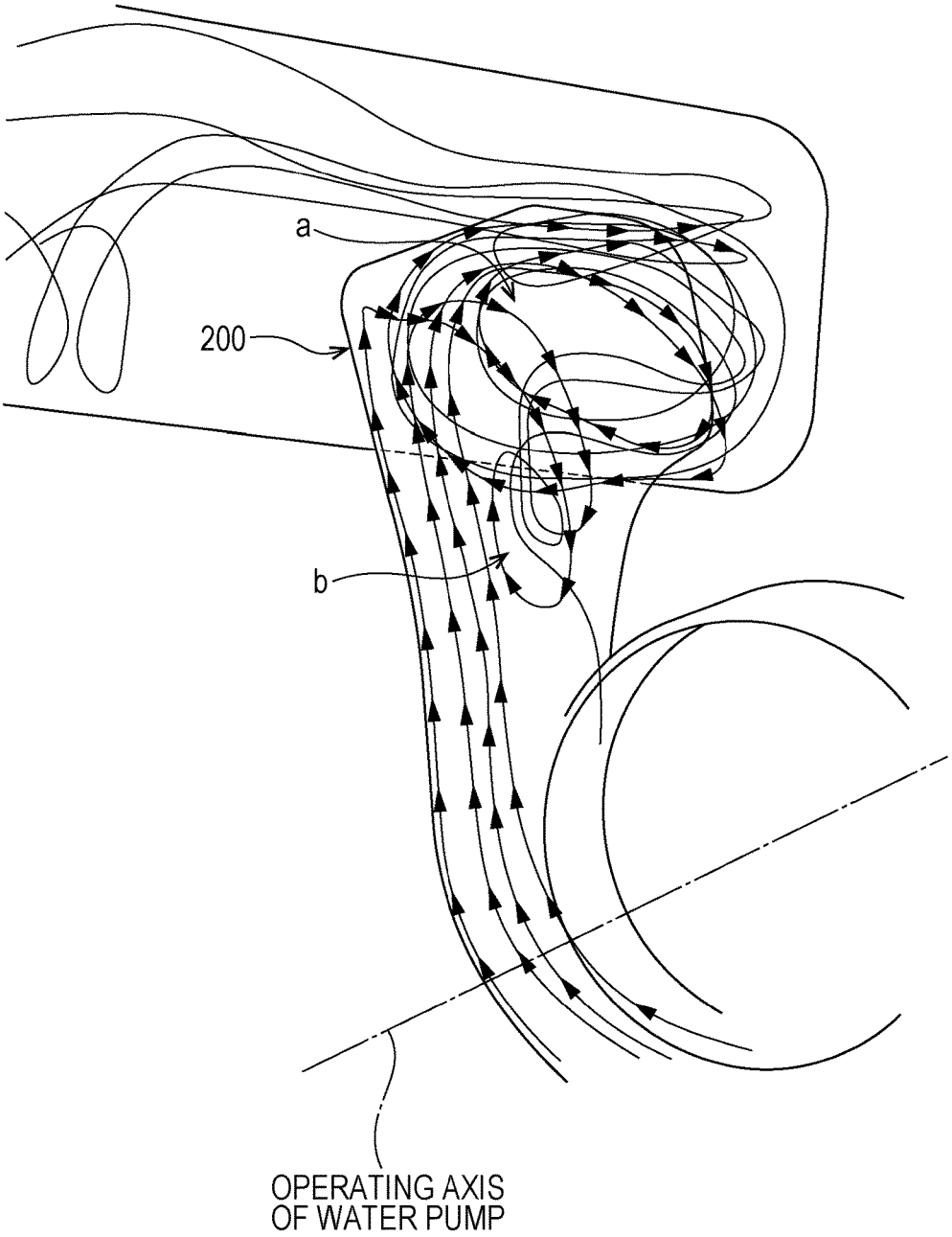
FIG. 11 illustrates a flow of water in a cooling water communication passage leading to a cylinder block (engine body) from a water pump of the related art.

FIG. 11 illustrates a flow of water in a cooling water communication passage leading to a cylinder block (engine body) from a water pump of the related art. In FIG. 11, a flow velocity obtained by fluid simulation is represented by a line with arrows.

As illustrated in FIG. 11, a portion of a cooling water communication passage 200 of the related art extends linearly in a direction toward the cylinder block (engine body). This is not only due to spatial and positional constraints for installation in an accessory unit block, but also because the linear shape makes it possible to reduce cost in the die-cutting process and improve mounting workability. The linear portion of the cooling water communication passage 200 extending toward the cylinder block (engine body) is larger in size than a portion on the water pump side. This is to reduce the flow velocity of cooling water toward the cylinder block (engine body).

The present application describes a cooling water passage structure that can reduce swirling flow in a small space and reduce pressure loss in a water passage.

The cooling water passage structure includes an internal combustion engine, a water pump, and a communication member having a cooling water communication passage for supplying cooling water from the water pump to a cooling water passage in the internal combustion engine. The cooling water communication passage is formed by a water pump housing containing the water pump, a first cooling water passage, and a second cooling water passage. Cooling water from the water pump housing passes through the first cooling water passage and the second cooling water passage to reach the cooling water passage in the internal combustion engine. The second cooling water passage is a cylindrical passage extending in a direction orthogonal to an operating axis of the water pump and displaced from an operating plane of the water pump. The first cooling water passage has a substantially triangular shape that widens from a vertex on the upstream side.

In this configuration, the first cooling water passage has a substantially triangular shape formed by combining planar surfaces. Therefore, as compared to a water passage formed by surfaces having the same radius of curvature, it is possible to reduce the occurrence of excessive swirling flow and reduce pressure loss in the water passage.

As viewed in the direction of the operating axis of the water pump, the first cooling water passage may have an inner surface on a water pump side and an outer surface on a side opposite the inner surface. The water pump housing may have a circular shape. The inner surface may have a water partition at a point touching the circle of the water pump housing. The outer surface may extend from a point of connection with the water pump housing in the direction of tangent to the water pump housing, pass through a point opposite the water partition, and turn to extend away from the water pump to widen the first cooling water passage.

For example, the water pump centrifugally discharges cooling water. Therefore, if the first cooling water passage gradually widens from the water pump housing, the flow of water along the inner surface of the first cooling water passage is slowed down. In the configuration described above, the outer surface of the first cooling water passage extends from a point of connection with the water pump housing in the direction of tangent to the water pump housing, passes through a point opposite the water partition, and then turns to extend away from the water pump to widen the first cooling water passage. This can reduce the possibility that water will swirl around the water partition at a point where the inner surface of the first cooling water passage touches the circle of the water pump housing and the flow velocity is relatively low.

As viewed in the direction of the operating axis of the water pump, the first cooling water passage may form a first plane in part of the outer surface, a third plane in part of the inner surface, and a second plane in part of a plane connecting the first plane to the third plane. A first imaginary line along the first plane, a second imaginary line along the second plane, and a third imaginary line along the third plane may intersect to form a triangle. The inner surface may have a curved portion extending from a lower end of a plane containing an end portion of the first cooling water passage, the end portion being on the water pump side and close to a point of intersection of the second imaginary line and the third imaginary line, to the water partition at the point of connection between the water pump housing and the inner surface. The first cooling water passage may be narrowed at the curved portion concaved from a fourth imaginary line connecting the end portion on the water pump side to the water partition.

In the configuration described above, the first cooling water passage is narrowed at the curved portion concaved from the fourth imaginary line. This can prevent collision between cooling water swirling in the triangular part and cooling water discharged from around the water partition. Also, since the first cooling water passage widens at the triangular part on the downstream side, cooling water can be supplied through a flow passage with large curvature.

As viewed in a direction orthogonal to the operating axis of the water pump and parallel to the second cooling water passage, an end portion of the first cooling water passage on the water pump side becomes more inclined with respect to a rotation plane of the water pump toward the second cooling water passage, with distance from the water pump in the direction of an operating axis of the second cooling water passage.

In the configuration described above, an end portion of the first cooling water passage on the water pump side is inclined toward the second cooling water passage. This allows cooling water splashing back from the inclined portion of the first cooling water passage to flow in the direction of the second cooling water passage. Therefore, it is possible to prevent collision with cooling water around the water pump and the resulting swirls. Moreover, the upper end portion of the first cooling water passage on the second cooling water passage side is not only inclined but is also significantly convex from a line tangent to the inner surface of the first cooling water passage. Therefore, it is possible to increase the width of inclination and more effectively reduce the occurrence of swirls.

As viewed in the direction of the operating axis of the water pump, a widest portion of the first cooling water passage may have a width that allows a flow velocity in a narrowest portion of the first cooling water passage to be maintained in the widest portion.

For example, if the flow passage is narrow, the flow quantity of cooling water decreases, and this results in a decrease in the absolute amount of cooling water that can flow. On the other hand, if the flow passage is too wide, the flow velocity decreases and the cooling water does not flow in some areas. With the configuration described above, where the first cooling water passage has a width which does not cause a significant decrease in flow velocity, it is possible to prevent creation of areas where the cooling water does not flow.

The first cooling water passage may have a shape formed by connecting the first imaginary line to the second imaginary line through a first semicircular portion, and connecting the second imaginary line to the third imaginary line through a second semicircular portion.

The semicircular corners of the triangular part of the first cooling water passage allow smooth flow of cooling water.

Obviously, numerous modifications and variations of the present invention are possible in light of the above teachings. It is therefore to be understood that within the scope of the appended claims, the invention may be practiced otherwise than as specifically described herein.

What is claimed is:

1. A cooling water passage structure comprising:

an internal combustion engine;

a water pump; and a communication member having a cooling water communication passage for supplying cooling water from the water pump to a cooling water passage in the internal combustion engine, wherein the cooling water communication passage is formed by a water pump housing containing the water pump, a first cooling water passage, and a second cooling water passage;

cooling water from the water pump housing passes through the first cooling water passage and the second cooling water passage to reach the cooling water passage in the internal combustion engine;

the second cooling water passage is a cylindrical passage extending in a direction orthogonal to an operating axis of the water pump, the second cooling water passage being displaced from an operating plane of the water pump;

the first cooling water passage has a triangular part with a substantially triangular shape that widens from a vertex on the upstream side and an upper communication part;

the upper communication part is configured to allow an upper portion of the triangular part to communicate with the second cooling water passage; and the upper communication part extends to the second cooling water passage and has substantially a same width as a width of the upper surface of the triangular part.

2. The cooling water passage structure according to claim 1, wherein as viewed in the direction of the operating axis of the water pump, the first cooling water passage has an inner surface on a water pump side and an outer surface on a side opposite the inner surface;

the water pump housing has a circular shape;

the inner surface has a water partition at a point touching the circle of the water pump housing; and the outer surface extends from a point of connection with the water pump housing in the direction of tangent to the water pump housing, passes through a point opposite the water partition, and turns to extend away from the water pump to widen the first cooling water passage.

3. The cooling water passage structure according to claim 1, wherein as viewed in the direction of the operating axis of the water pump, the first cooling water passage forms a third plane in part of an inner surface thereof on a water pump side, a first plane in part of an outer surface thereof on a side opposite the inner surface, and a second plane in part of a plane connecting the first plane to the third plane;

a first imaginary line along the first plane, a second imaginary line along the second plane, and a third imaginary line along the third plane intersect to form a triangle;

the inner surface has a curved portion extending from a lower end of a plane containing an end portion of the first cooling water passage, the end portion being on the water pump side and close to a point of intersection of the second imaginary line and the third imaginary line, to a water partition at the point of connection between the water pump housing and the inner surface; and the first cooling water passage is narrowed at the curved portion concaved from a fourth imaginary line connecting the end portion on the water pump side to the water partition.

4. The cooling water passage structure according to claim 1, wherein as viewed in a direction orthogonal to the operating axis of the water pump and parallel to the second cooling water passage, an end portion of the first cooling water passage on a water pump side becomes more inclined with respect to a rotation plane of the water pump toward the second cooling water passage, with distance from the water pump in the direction of an operating axis of the second cooling water passage.

5. The cooling water passage structure according to claim 1, wherein as viewed in the direction of the operating axis of the water pump, a widest portion of the first cooling water passage has a width that allows a flow velocity in a narrowest portion of the first cooling water passage to be maintained in the widest portion.

6. The cooling water passage structure according to claim 1, wherein the first cooling water passage has a shape formed by connecting a first imaginary line to a second imaginary line through a first semicircular portion and connecting the second imaginary line to a third imaginary line through a second semicircular portion, the third imaginary line being along a third plane formed in part of an inner surface of the first cooling water passage on a water pump side, the first imaginary line being along a first plane formed in part of an outer surface of the first cooling water passage on a side opposite the inner surface, the second imaginary line being along a second plane formed in part of a plane connecting the first plane to the third plane.

7. The cooling water passage structure according to claim 1, wherein the second cooling water passage includes a longitudinal axis extending in the direction orthogonal to the operating axis of the water pump.

8. The cooling water passage structure according to claim 1, wherein the second cooling water passage is spaced from water pump in a height direction of the internal combustion engine.

9. The cooling water passage according to claim 1, wherein the upper communication part extends in an operating axis direction of the water pump.

10. A cooling water passage structure comprising:

a cooling water passage in an internal combustion engine;

a water pump; and a communication member having a cooling water communication passage to supply cooling water from the water pump to the cooling water passage, the cooling water communication passage comprising:

a water pump housing containing the water pump;

a first cooling water passage having a triangular part with a substantially triangular shape that widens from a vertex on an upstream side and an upper communication part; and a second cooling water passage comprising a cylindrical passage extending in a direction orthogonal to an operating axis of the water pump, the second cooling water passage being displaced from an operating plane of the water pump, cooling water from the water pump housing being to pass through the first cooling water passage and the second cooling water passage to reach the cooling water passage in the internal combustion engine, wherein the upper communication part is configured to allow an upper portion of the triangular part to communicate with the second cooling water passage, and wherein the upper communication part extends to the second cooling water passage and has substantially a same width as a width of the upper surface of the triangular part.

11. The cooling water passage structure according to claim 10, wherein as viewed in a direction of the operating axis of the water pump, the first cooling water passage has an inner surface on a water pump side and an outer surface on a side opposite the inner surface;

the water pump housing has a circular shape;

the inner surface has a water partition at a point touching a circle of the water pump housing; and the outer surface extends from a point of connection with the water pump housing in a direction of tangent to the water pump housing, passes through a point opposite the water partition, and turns to extend away from the water pump to widen the first cooling water passage.

12. The cooling water passage structure according to claim 10, wherein as viewed in a direction of the operating axis of the water pump, the first cooling water passage provides a third plane in part of an inner surface thereof on a water pump side, a first plane in part of an outer surface thereof on a side opposite the inner surface, and a second plane in part of a plane connecting the first plane to the third plane;

a first imaginary line along the first plane, a second imaginary line along the second plane, and a third imaginary line along the third plane intersect to provide a triangle;

the inner surface has a curved portion extending from a lower end of a plane containing an end portion of the first cooling water passage, the end portion being on the water pump side and close to a point of intersection of the second imaginary line and the third imaginary line, to a water partition at a point of connection between the water pump housing and the inner surface; and the first cooling water passage is narrowed at the curved portion concaved from a fourth imaginary line connecting the end portion on the water pump side to the water partition.

13. The cooling water passage structure according to claim 10, wherein as viewed in a direction orthogonal to the operating axis of the water pump and parallel to the second cooling water passage, an end portion of the first cooling water passage on a water pump side becomes more inclined with respect to a rotation plane of the water pump toward the second cooling water passage, with distance from the water pump in a direction of an operating axis of the second cooling water passage.

14. The cooling water passage structure according to claim 10, wherein as viewed in a direction of the operating axis of the water pump, a widest portion of the first cooling water passage has a width that allows a flow velocity in a narrowest portion of the first cooling water passage to be maintained in the widest portion.

15. The cooling water passage structure according to claim 10, wherein the first cooling water passage has a shape provided by connecting a first imaginary line to a second imaginary line through a first semicircular portion and connecting the second imaginary line to a third imaginary line through a second semicircular portion, the third imaginary line being along a third plane provided in part of an inner surface of the first cooling water passage on a water pump side, the first imaginary line being along a first plane provided in part of an outer surface of the first cooling water passage on a side opposite the inner surface, the second imaginary line being along a second plane provided in part of a plane connecting the first plane to the third plane.

16. The cooling water passage structure according to claim 10, wherein the second cooling water passage includes a longitudinal axis extending in the direction orthogonal to the operating axis of the water pump.

17. The cooling water passage structure according to claim 10, wherein the second cooling water passage is spaced from water pump in a height direction of the internal combustion engine.

18. The cooling water passage structure according to claim 10, wherein the upper communication part extends in an operating axis direction of the water pump.

* * * * *